US006168688B1

(12) United States Patent
Clot et al.

(10) Patent No.: US 6,168,688 B1
(45) Date of Patent: Jan. 2, 2001

(54) METHOD AND PLANT FOR TREATING SOLID WASTE PRODUCTS BY THERMOLYSIS

(75) Inventors: Guy Clot, Uzes; Jean Roure, Saint-Remy-de-Provence, both of (FR)

(73) Assignee: Societe Francaise de Thermolyse (FR)

( * ) Notice: Under 35 U.S.C. 154(b), the term of this patent shall be extended for 0 days.

(21) Appl. No.: 09/091,302

(22) PCT Filed: Oct. 15, 1997

(86) PCT No.: PCT/FR97/01839

§ 371 Date: Jun. 15, 1998

§ 102(e) Date: Jun. 15, 1998

(87) PCT Pub. No.: WO98/16593

PCT Pub. Date: Apr. 23, 1998

(30) Foreign Application Priority Data

Oct. 15, 1996 (FR) ..... 96 12551
Oct. 15, 1996 (FR) ..... 96 12550

(51) Int. Cl.[7] ..... B09B 3/00; C10B 53/00

(52) U.S. Cl. ..... 201/25; 201/15; 201/27; 201/30; 201/37; 202/96; 202/99; 48/197 R; 422/184.1; 423/DIG. 18; 588/228

(58) Field of Search ..... 588/213, 216, 588/220, 228; 201/15, 25, 27, 30, 37; 48/197 R; 202/96, 99; 423/DIG. 18; 422/184.1

(56) References Cited

U.S. PATENT DOCUMENTS 3,525,673 8/1970 Cameron ..... 588/226

FOREIGN PATENT DOCUMENTS 26 21 392 A1 * 11/1977 (DE) ..... 201/25
35 09 275 A1 * 12/1985 (DE) .
42 02 321 A1 * 8/1993 (DE) ..... 201/25
0 505 278 A1 9/1992 (EP) .
0 524 847 A1 1/1993 (EP) .
0 610 120 A1 8/1994 (EP) .

* cited by examiner

*Primary Examiner*—Tom Dunn
*Assistant Examiner*—Timothy C Vanoy
(74) *Attorney, Agent, or Firm*—Vanophem Meehan & Vanophem, P.C.

(57) ABSTRACT

A method and apparatus is provided for the thermolysis of solid waste within an enclosed thermolysis chamber in the absence of free oxygen which produces a thermolysis off-gas. The thermolysis off-gas is removed from the thermolysis chamber and injected into a cyclone where it is washed with water and cooled. The washed and cooled thermolysis off-gas is divided into two portions. One portion of the washed thermolysis off-gas is further cooled in a heat exchanger and then injected into a burner and combusted, while the remaining portion of the washed thermolysis off-gas is passed into indirect heat exchange with the hot off-gas resulting from the combustion of the other portion of the thermolysis off-gas in the burner and recycled back into the enclosed thermolysis chamber. This in-situ recycling of hot thermolysis off-gas helps prevent the creation of hot spots in the thermolysis chamber and the possibility of an explosive reaction between oxygen and hydrogen. The catalytic radiant panels and burners can be replaced with the injection of hot thermolysis gas back into the thermolysis area.

27 Claims, 3 Drawing Sheets

METHOD AND PLANT FOR TREATING SOLID WASTE PRODUCTS BY THERMOLYSIS

BACKGROUND OF THE INVENTION

1. Field of the Invention

The present invention concerns a method and plant for treating by thermolysis solid waste products whose disposal is harmful to the environment.

2. Description of the Prior Art

Document EP-A-0 610 120 discloses a plant facility for treating solid waste products whose disposal is harmful to the environment including a dehydration area into which the solid products are fed, a thermolysis area downstream of the dehydration area, an outlet area in which the solid residues are cooled and a pumping station communicating via an extraction line with the thermolysis area to maintain it at a reduced pressure and to aspirate thermolysis gases from it.

The pump station communicate via a combustible gas feed line with a boiler for burning the thermolysis gases which are maintained at a temperature greater than the temperature of condensation of tars that can form in the gaseous state during thermolysis, before they are used as fuel in the boiler. The thermolysis gases are exploited directly to generate thermal energy that is transformed in the plant or fed to a turbine that converts it to electrical energy or used for any other function, possibly external to the plant facility.

The boiler can also use the fuel (coal) contained in the solid residues.

The flue gases from the boiler are used to heat the dehydration area.

To enable thermolytic transformation in the total absence of free oxygen the dehydration, thermolysis and cooling areas consist of chambers isolated from each other in a substantially airtight manner.

The dehydration and thermolysis chambers are provided with heating elements such as catalytic radiator panels or flame burners using the thermolysis gases and/or (low price) commercially available combustible gases.

In the case of burners the enclosures of the aforementioned chambers are heated by radiation from the inside wall of the chambers heated by the burner flames. In this case heating is also assured by convection of the gases in the charge of products to be treated which is assured by expansion of the gases generated in the corresponding chamber.

The catalytic radiant panels are fed with pure oxygen or with air and with thermolysis gases resulting from thermolytic decomposition. In this case the carbon dioxide and the steam generated by oxidation of the thermolysis gases in the catalytic radiant panels can contribute to heating by convection and radiation.

As mentioned above, the flue gases from the boiler can also be used to heat the aforementioned chambers.

Thus the temperature of the thermolysis chamber is maintained at around 600° C., for example, and that of the dehydration chamber is maintained at a lower temperature above 100° C., for example around 120° C.

The solution described in document EP-A-0 610 120 is satisfactory overall. However, the use of burners in the dehydration and thermolysis chamber generates hot spots exposing the chambers to non-negligible mechanical stresses. These mechanical stresses can give rise to sealing problems which can be particularly troublesome because the penetration of oxygen into the thermolysis chamber can cause an explosion in the presence of hydrogen in the thermolysis chamber.

This risk of explosion is also present when catalytic radiator panels are used because they employ oxygen as a combustion-supporting gas.

Moreover, heating the chambers consumes external energy when commercially available combustible gases are used.

Document U.S. Pat. No. 3,525,673 describes another method of treating organic waste and the corresponding plant facility. In this method the waste is reduced to basic carbon-containing products by superheated steam at a low positive pressure in a closed circuit. The steam recovered after passing through the waste is condensed and the uncondensed gases are separated from the water and the substances dissolved therein.

BRIEF SUMMARY OF THE INVENTION

This method is limited to the treatment of organic waste and consumes large quantities of water.

The present invention aims to alleviate these drawbacks.

An underlying objective of the present invention is a method of treating solid waste products, whose disposal is harmful to the environment, that is self-sufficient from the energy point of view.

To this end the present invention proposes a method of treating solid waste products, whose disposal is harmful to the environment, including a step of thermolysis of the solid products in a thermolysis area, wherein:

- the gases are aspirated from the thermolysis area;
- at least a portion of the aspirated gases is cooled to a temperature less than approximately 80° C.;
- the condensed products from cooling the uncondensed gases are separated from this cooling;
- a portion of the aspirated gases is heated by combustion of at least a part of the uncondensed gases; and
- the heated portion of the gases is recycled by feeding it back into the thermolysis area.

The invention also teaches replacing the catalytic radiant panels or burners with direct injection of a flow of hot gases including recycled thermolysis gases into the thermolysis area.

This prevents the creation of hot spots and any possibility of an explosive reaction between oxygen and hydrogen.

In situ recycling of the thermolysis gases also renders the treatment method of the present invention self-sufficient.

Thermolysis effected in this way, by forced circulation of a flow of hot gas resulting from feeding the flow into the thermolysis area, direct contact with the charge and then aspiration of the gases from the thermolysis area, is found to be particularly regular but most importantly significantly faster than thermolysis carried out in accordance with the teaching of document EP-A-0 610 120.

Moreover, a maximum of solid products treated by the method of the present invention is converted into energy. In particular, the tars obtained on cooling can be mixed with the fuel (coal) from the solid residues from the thermolysis area, for example, to constitute a fuel for subsequent exploitation.

Cooling at least some of the gases from the thermolysis area facilitates exploitation of the thermolysis products. Converting some of the gases from the thermolysis area into condensed products minimizes the volume of the means for storing the products (tars, etc). Furthermore, the uncondensed gases are advantageously reused to heat the flow of gas to be fed into the thermolysis area.

Finally, this cooling protects the treatment plant facility and in particular the pump utilized in the process.

To improve further the efficiency of thermal transfer of this thermolysis process, in a relatively simple manner, the heated portion of the gas is advantageously injected in the immediate proximity of a static charge of solid products to be treated.

In one preferred embodiment the portion of the gas to be heated is a second part of the uncondensed gases obtained by cooling.

Thus a fraction of the uncondensed thermolysis gases is burned to heat a second part of the uncondensed gases which are recycled and returned to the thermolysis area to be enriched with thermolysis gases and in particular with hydrogen and hydrocarbons (methane, ethane, ethylene, etc).

In another embodiment, a first fraction of the aspirated gases is heated to approximately 60° C. to approximately 80° C. and a second fraction of the aspirated gases is heated to approximately 230° C. to approximately 330° C., at least some of the uncondensed gases from the first fraction are burned, the uncondensed gases from the second fraction are heated by means of the gases resulting from this combustion, the heated second fraction of the gases constituting the heated gas portion, and the condensed products obtained by cooling the first and second fractions are recovered.

In this embodiment, the gas fraction to be heated and recirculated into the thermolysis area in the form of a flow of hot gas is maintained at a higher temperature than the fraction to be burned. The fraction to be heated therefore requires less heating before it is fed back into the thermolysis area.

In this case the solid products are dehydrated prior to thermolysis, in the thermolysis area and using some of the gases resulting from combustion.

In this case the combustion is carried out in a boiler equipped with fiber type burners.

Burners of this kind are able to burn relatively impoverished gases, and in particular the thermolysis gases from an area for thermolysis of waste products constituting the solid products to be treated. Moreover, this combustion method maintains a low concentration of $NO_X$ in the flue gases.

To start the treatment process liquefied gas such as propane can be burned in the boiler. If required to assure correct combustion, a certain proportion of liquefied gas can also be added to the thermolysis gases to be burned.

To avoid dependence on the composition of the thermolysis gases, or even on their production, they are compressed and stored in a storage tank prior to combustion.

In a preferred embodiment, the aspirated gases pass through a heat exchanger, as the hot fluid, after which the gases pass through a fractionating system to obtain separated fractions respectively containing heavy hydrocarbons, light hydrocarbons, water and uncondensed gases at low temperature; a part of the uncondensed gases at low temperature is re-injected into the heat exchanger, as the cold fluid, to raise its temperature before it is heated by combustion of another part of the uncondensed gases at low temperature.

In this preferred embodiment the boiler is equipped with multi-fuel (gas and liquid) burners so that it can burn not only the uncondensed gases but also the light hydrocarbons, the organic substances dissolved in the water and separated therefrom, fuel oil or propane.

Furthermore, dehydration and thermolysis are carried out simultaneously.

To start the process an inert gas (nitrogen, etc) or uncondensed gases previously stored are heated by combustion by one of the fuels just mentioned, some of which would then result from earlier treatment.

For implementation of the method of the present invention there is also proposed a plant facility for treatment of solid waste products whose disposal is harmful to the environment, including an area for thermolysis of solid products by direct contact with hot gases, a line for feeding a flow of hot gases into the thermolysis area, a line for extracting gases from the thermolysis area, and means for cooling at least a part of the gases extracted from the thermolysis area to a temperature less than approximately 80° C. and separating the condensed products from cooling from the uncondensed gases from the same cooling, disposed on the extraction line, characterized in that it includes pump facility communicating via the extraction line with the thermolysis area for aspirating the gases therefrom, a boiler adapted to burn at least a part of the uncondensed gases and communicating via an incoming line with the cooling and separator means, and a line for recycling a part of the gases extracted from the thermolysis area, the recycling line being fluidically connected to the extraction line and to the feed line and passing through the boiler to heat the gases flowing in the recycling line.

The plant facility can further include a line for feeding liquefied gas, such as propane, into the boiler, enabling a mixture to be maintained at an acceptable net calorific value in terms of combustion performance and starting up the installation.

BRIEF DESCRIPTION OF THE DRAWINGS

Other aims, features and advantages of the present invention emerge from the following detailed description given by way of non-limiting example and with reference to the appended drawings, in which.

DETAILED DESCRIPTION OF THE PREFERRED EMBODIMENT

Figure 1:
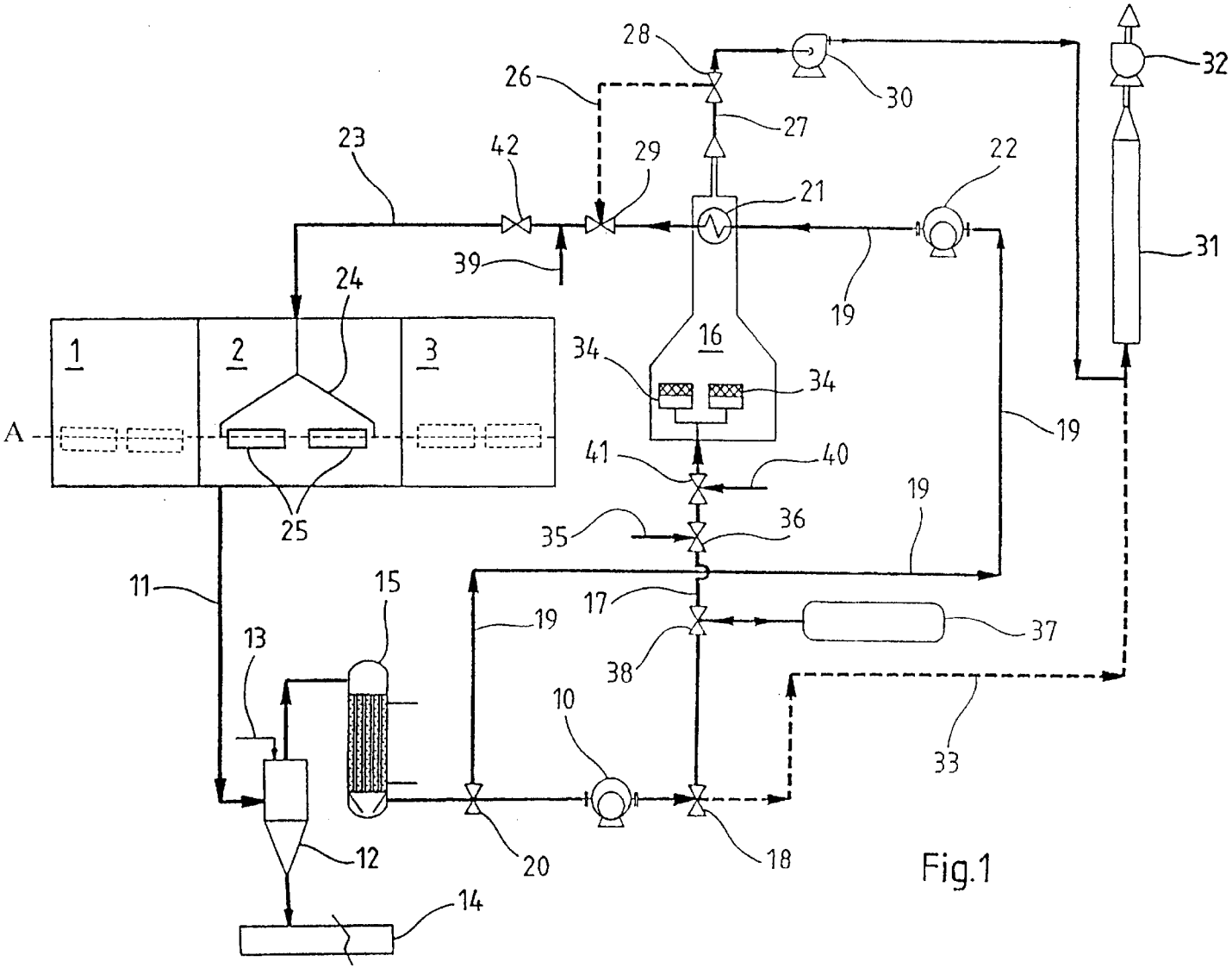
FIG. 1 is a theoretical schematic of the plant facility constituting one embodiment of the present invention.

The plant facility shown schematically in FIG. 1 includes an airlock 1 into which the solid products are fed followed by a thermolysis area 2 in which the solid products are first partly or totally dehydrated and then heated to their thermal decomposition temperature (known and fixed in advance), for example around 600° C.

The thermolysis area is preferably followed by a cooling area 3 in which the solid residues of thermal treatment are cooled to room temperature, for example by water sprinklers.

The thermolytic conversion is advantageously carried out in the total absence of free oxygen.

As is also taught in the aforementioned document, the areas 1, 2 and 3 are preferably chambers isolated from each other in a substantially airtight manner, for example by guillotine doors (not shown) actuated by cylinders, the door between chambers 1 and 2 and the door between chambers 2 and 3 being mobile transversely in airtight housings (registers). Airtight doors are also provided at the entry to chamber 1 and at the exit from chamber 3, so that the airlock and the cooling area 3 are intentionally isolated from the exterior and/or from the thermolysis area 2; they can be mobile vertically or horizontally or hinged, depending on the dimensions of the plant, the space available and the preference of the designer.

It will be realized that the seal provided by the entry and exit doors is between the outside and areas 1 and 3 at moderate temperatures, very much lower than that in the chamber 2.

To prevent air entering the chamber 2 the products are fed in and the residues are extracted via airlocks which alternately and as required isolate the airlock 1 from the thermolysis chamber 2, when the products are fed into the airlock 1, and the thermolysis chamber 2 from the cooling chamber 3, when the residues are extracted from this third chamber.

The thermolysis chamber 2 is thermally insulated to limit heat losses.

The chamber 2 is maintained at a constant pressure which can be in the range 200 mbars to 1.2 bars. The same set point pressure is preferably chosen in chambers 1, 2 and 3.

The pressure is maintained, for example, by a pump station 10 communicating with the chamber 2 via an extraction line 11. For simplicity FIG. 1 does not show the pump station in the cooling area and the airlock.

A cyclone 12 on the extraction line 11 supplied with water via a feed 13 divides the gases from the thermolysis chamber 2 into a fraction containing water and tars recovered in a pitch tank 14 and an uncondensed gas fraction. The uncondensed gas fraction is cooled in a cooler consisting of a tube type heat exchanger 15 through which a refrigerant flows downstream of the cyclone 12 on the extraction line 11.

The thermolysis gases extracted from the chamber 2 are therefore cooled from a temperature of approximately 500° C. on leaving the chamber 2 to a temperature of approximately 80° C. in the cyclone 12 and then to a temperature of approximately 60° C. on leaving the heat exchanger 15.

In particular, this separates the steam from the thermolysis gases, at least some of which are burned in a boiler 16 (see below). However, this cooling also has the advantage of protecting the conventional mechanical pump station 10 which would wear excessively if the gases they pump were at a temperature greater than approximately 80° C.

In this embodiment, a first part of the uncondensed gas fraction is burned in the boiler 16 and a second part of the uncondensed gas fraction is heated by means of the gases produced by combustion of said first part in the boiler 16, this heated second part of the uncondensed gases being fed into the thermolysis chamber 2.

To be more precise, in a first branch circuit, the first part of the uncondensed fraction is fed to the boiler 16 via an uncondensed thermolysis gas feed line 17 communicating with the first pump means 10 via a valve 18.

A second thermolysis gas branch circuit consists of a recycling line 19 communicating with the extraction line 11 between the tube type heat exchanger 15 and the pump station 10. The recycling line 19 is connected to the extraction line 11 via a distributor valve 20 at one end and a coil 21 in the flue of the boiler 16 at the other end. A second pump station 22 is also provided on the recycling line 19, between the distributor valve 20 and the coil 21, near the latter.

The outlet of the coil 21 communicates with a line 23 for feeding hot gas into the chamber 2. The feed line 23 enables direct injection of the flow of hot gas heated in the boiler 16, in the immediate proximity of the charge of solid products to be treated, by means of a hood 24 covering the wagon or wagons 25 in the chamber 2 during the thermolysis step. Note that in the conventional way the wagons are moved in the chambers 1, 2 and 3 by a mechanical rack and pinion type system A, for example, or an electromagnetic type drive system. The wagons are designed so that the solid residues—glass, debris, metals, for example—remain in the wagons 25 but are easily removable at the exit from the cooling chamber 3.

Additionally, the feed line 23 also enables combustion gases to be fed into the boiler 16 or flue gases of the chamber 2 to dehydrate the charge of solid products to be treated prior to thermolysis. A dehydration line 26 provided for this purpose communicates with an exhaust line 27 for flue gases or combustion gases in the boiler 16, via a regulator valve 28, and with the feed line 23 via a connecting valve 29.

The smoke leaving the boiler that is not used is sent via a fan 30 into a washer 31 for cleaning the flue gases before they are exhausted into the atmosphere. A second fan 32 is provided at the exit from the washer 31 to facilitate exhausting the clean flue gases into the atmosphere.

FIG. 1 also shows an exhaust line 33 for flue gases extracted from the chamber 2 during dehydration, connected at one end to the valve 18 and at the other end to the washer 31.

To carry out the combustion the boiler 16 is equipped with fiber type burners 34, which include a trellis of fibers. This type of burner is of special interest because it can burn gases that are relatively impoverished from the energy point of view. One such burner is the "BEKITHERM AC" type sold by ACOTECH.

Nevertheless, for situations in which the net calorific value of the thermolysis gases would be too low for correct combustion a feed line 35 for a liquefied gas, for example propane, is connected to the thermolysis gas feed line 17 via a feed valve 36.

A storage tank 37 for storing thermolysis gas is connected to the feed line 17 between the valve 18 and the feed valve 36 via a connecting valve 38 so that combustion in the boiler 16 is not dependent on the instantaneous richness of the thermolysis gases from the chamber 2 or on the production of these gases with a net calorific value that is acceptable in terms of combustion performance. Compressor means (not shown) are also provided to compress the gases before they are stored in the storage tank 37.

The combustion gases having a temperature of approximately 800° C., while dehydration is carried out at a temperature in the range 100° C. to 150° C., preferably around 120° C., a line 39 equipped with a heat exchanger to produce or to heat steam is connected to the feed line 23. The heat energy recovered in this way can be fed in situ to a turbine (not shown) which converts it into electrical energy for driving the pump means 10 and 22 and the fans 30 and 32, for example, or for any other purpose, possibly external to the plant.

A combustion-supporting oxygen line 40 is connected to the feed line 17 downstream of the liquefied gas feed line 35 via a connecting valve 41. This line can carry pure oxygen or merely air.

The skilled person knows how to choose appropriate valves for use at the respective locations of the plant described with reference to FIG. 1.

Note also that pressure and temperature control means, not shown, are installed on the various chambers 1, 2 and 3 and on the boiler 16. Means for regulating the flow of gas to each burner on entering the boiler 16, also not shown in FIG.

1, are provided at the input to the boiler 16. The skilled person knows how to choose and use such control and regulation means and means for monitoring the quantity of oxygen in the boiler 16 or the quantity of hydrogen in the plant.

The valve 42 on the feed line 23 isolates and regulates the flow of gas from the lines 26 and 19.

The solid residues leaving the cooling area 3 are wet treated to separate the fine minerals from the coal. The coal can be mixed with the tars recovered by settling out in the pitch tank 14 to make a combustible mixture. The combustible mixture can be burned in the boiler 16, for example, or external to the plant, for example to produce electrical energy.

Operation

The treatment plant of the present invention, as shown diagrammatically in FIG. 1, operates in the following manner:

Solid products (for example domestic waste) contained in wagons 25 are passed in succession by means of any convenient conveying system A into and past the airlock 1 and into the thermolysis area or chamber 2.

The boiler 16 is started up by combustion of liquefied gas only or, if thermolysis gases are present in the storage tank 37, by combustion of the latter, or even by mixing the latter with liquefied gas in order to produce combustion or flue gases. The flue gases are sent via the dehydration line (via the feed line 23) into a chamber 2 for dehydrating the solid products, after they have been cooled in the line 39.

The flue gases charged with steam and, where applicable, other gases produced by the corresponding heating, are aspirated through the exhaust line 11, the cyclone 12 (essentially to condense the steam) and the tube type heat exchanger 15 by the pump station 10 and then sent at least in part via the exhaust line 33 into the washer 31 and finally discharged into the atmosphere.

In a second step of the treatment in accordance with the present invention, applied to the plant facility shown in FIG. 1, a flow of hot gas (at a temperature in the range 300° C. to 900° C.) is fed into the chamber 2 to thermolyze the solid products that have just been dehydrated, this thermolysis taking place at a temperature in the range approximately 250° C. to approximately 750° C.

The hot gases fed into the chamber 2 are enriched with hydrogen and hydrocarbons (methane, ethane, ethylene) on contact with the charge of solid products to be treated, which raises the net calorific value of these gases (in practise from 4 000 kJ/kg to 18 000 kJ/kg–19 000 kJ/kg), but also of other gases, in particular carbon dioxide, carbon monoxide, etc.

These gases are recovered at a temperature of approximately 500° C. on the extraction line 11 and are then aspirated by the pump means 10 into the cyclone 12 and the tube type heat exchanger 15 where the separation processes mentioned below are carried out.

Part of the uncondensed thermolysis gases leaving the exchanger 15 is sent into the storage tank 37 or directly into the boiler 16 for combustion and a second part is sent into the recycling line 19 where, after being accelerated by the pump station 22, this second part of the gases is heated by passing it through the coil 21 and then fed via the feed line 23 into the chamber 2.

Note that if the hot gases to be fed into the chamber 2 are at a temperature above approximately 650° C. the heat exchange line 39 could be used to lower the temperature, as during dehydration.

Furthermore, at the beginning of the thermolysis step a part of the flue gases extracted from the chamber 2 during dehydration or the flue gases from combustion of the thermolysis gases stored in the storage tank 37 could be used for recycling, sent via the dehydration line 26 into the feed line 23 and cooled to the required temperature. Note that in other embodiments thermolysis gases from the storage tank 37 could be used for this recycling by providing an appropriate branch connection to the recycling line 19.

It will be seen that this plant facility increases the net calorific value and the richness of the gases each time they pass through the charge.

The solid residues, tars and flue gases are treated as mentioned above during this process.

Figure 2:
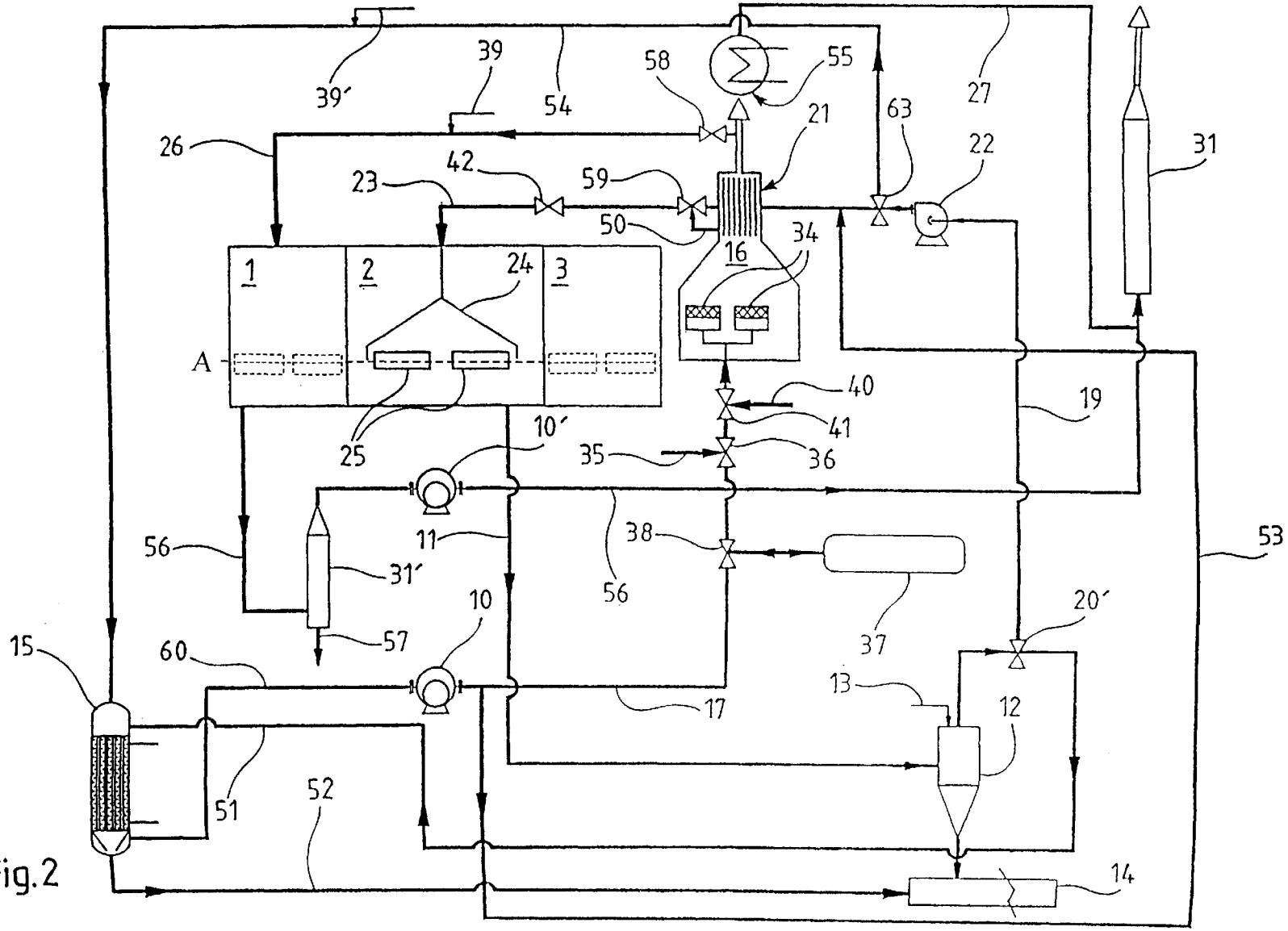
FIG. 2 is a schematic of another embodiment of this plant facility.

FIG. 2 shows another embodiment in which elements similar to those from FIG. 1 are designated by the same reference numbers.

The principal differences between this plant and that from FIG. 1 result firstly from the choice to carry out dehydration in a chamber 1 separate from the thermolysis chamber 2 and fed with combustion gas (flue gases) from the boiler 16 via a dehydration line 26 independent of the feed line 23 and connected to the line 27 via a valve 58. The line 23 includes at the location of the valve 59 an inlet 50 for combustion gas that can be mixed in a certain proportion with the thermolysis gases to be recycled via the recycling line 19.

The plant facility then includes cooling and separation or division means disposed in a specific manner. Here, these means include a cyclone 12 which cools the gas from the thermolysis chamber 2 to a temperature in the range approximately 230° C. to approximately 330° C. Part of these gases is used in the recycling line 19 (branch connection at the location of the valve 20') and another part of the gases, to be burned in the boiler 16, is sent via a cooling line 51 into the tube type heat exchanger 15 to be cooled to a temperature in the range approximately 60° C. to approximately 80° C.

Note that the pump station 22, which consists of a vacuum pump in the FIG. 1 plant facility, have been replaced by a fan.

On leaving the tube type heat exchanger 15 the liquid hydrocarbons (tars) and the water are sent into the pitch tank 14 via the output line 52. An uncondensed gas recovery line 60 communicates with the exchanger 15 and with the pump station 10. There is no fan at the exit from the washer 31 or on the flue gases output line 57. The solid pitch formed in the cyclone 12 is also sent to the pitch tank 14.

The recycling line 19 is fed via a line 53 with impoverished and cooled gas leaving the pump means 10 communicating with the tube type heat exchanger 15.

The gases from the line 53 are at a temperature of approximately 50° C. and are mixed with the gases from the recycling line downstream of the fan 22, enabling the gas to be recovered at a temperature in the order of 230° C.

Moreover, before it is mixed with the impoverished and cooling gases, a part of the gas flowing in the recycling line 19 is sent to the tube type heat exchanger 15 via a line 54 at the location of the valve 63. In practise these gases are at a temperature of approximately 150° C. in this line and reach the input of the tube type heat exchanger 15 at a temperature of approximately 120° C.

This handles the overflow of thermolysis gas to be partially condensed.

Here the steam is produced or heated for subsequent exploitation not only on the dehydration line 26 but also on the line 54 (cf. lines 39 and 39' in FIG. 2) and at the exit from the boiler 16 by means of the flue gases sent to the washer 31 through a heat exchanger 55.

Finally, before entering the washer 31, the flue gases from the dehydration circuit pass through a secondary washer 31' and pump station 10' maintaining the required pressure in the dehydration chamber 1 disposed on the dehydration flue gases line 56. This prevents damage to the pump means 10' and liquid hydrocarbons (tars) that can be exploited are recovered at the exit from the washer 31' (arrow 57).

Because of these arrangements at least a part of the gases to be recycled is maintained at a temperature in the range approximately 230° C. to approximately 330° C., subject to the circuit being slightly more complex.

Otherwise, the operation of this plant is substantially to that described with reference to FIG. 1.

Figure 3:
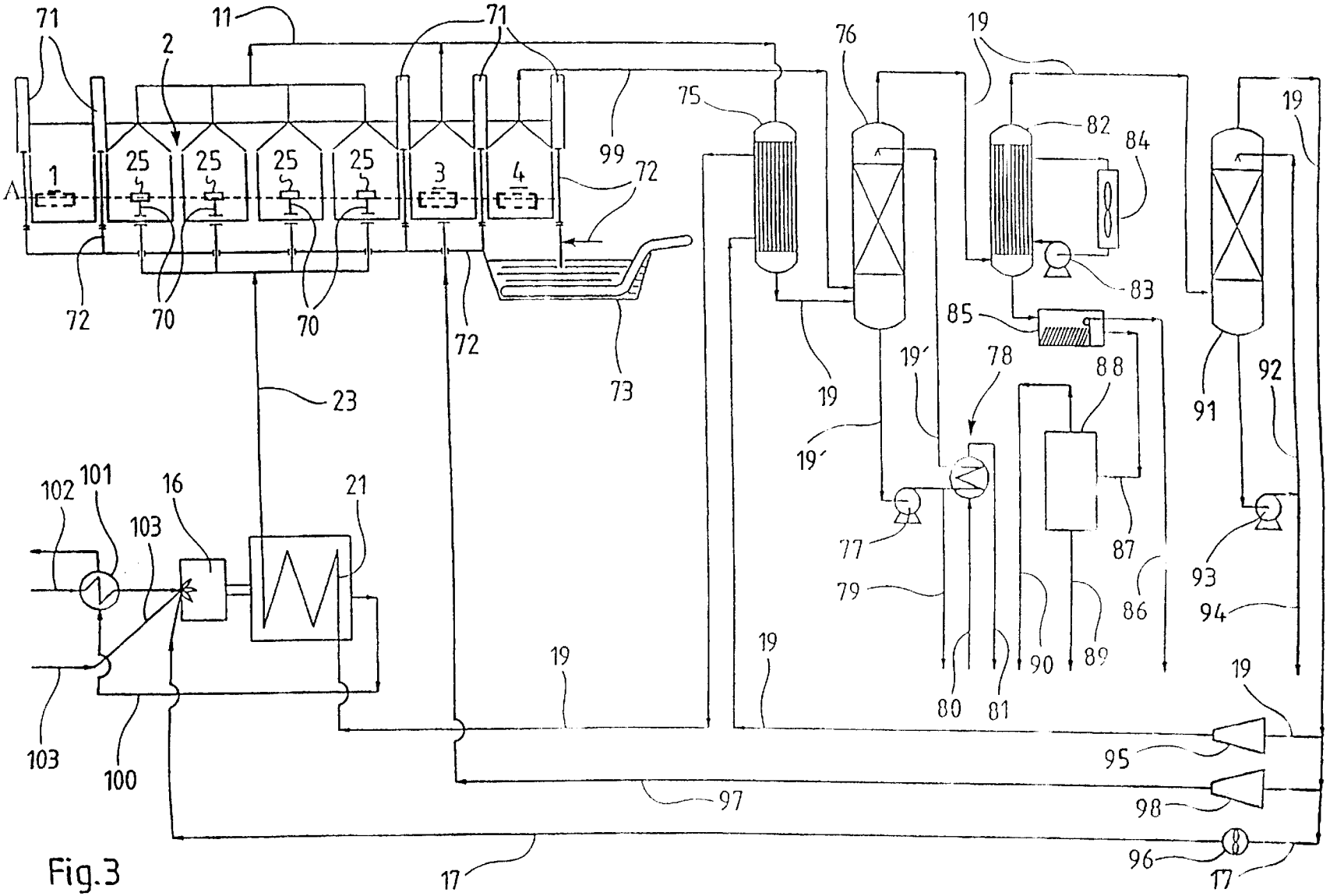
FIG. 3 is a schematic of a preferred embodiment of this plant.

FIG. 3 represents a preferred embodiment in which elements similar to those from FIG. 1 are designated by the same reference numbers.

The main differences of this plant relative to that from FIG. 1 are as follows:

The feed line 23 communicates directly with the interior of each of the wagons 25 via a coupling member or fluid connection 70.

Each of the wagons 25 has a perforated bottom adapted to carry the charge of products to be treated and to transmit the hot gases to the charge.

The coupling member 70 can be a telescopic device moving a bellows fitted to one end of a tube to a connection area on the bottom of the wagon 25, for example.

The wagon 25 can carry a grid to receive solid products to be treated, for example, or a tank with regularly distributed nozzles discharging onto the bottom of the tank and fluidically connected to the connection area by a system of tubes.

In this way the hot gases can be injected directly into the charge of waste to be treated, which in particularly reduces the risk of unburned waste due to intimate contact of the hot gases with the charge of waste to be treated, with no preferential pathways.

FIG. 3 shows guillotine doors 71 for isolating the chambers from each other.

To obtain areas as inert as possible at the doors 71, steam is fed to these locations via the circuit 72.

An area 4 for unloading the wagons 25 is provided after the cooling area 3. The residues are tipped into a pool 73 from which they are then extracted and then sorted.

During the thermolysis step the gases in the chamber 2 are aspirated via the extraction line 11 at a temperature which in this preferred embodiment is approximately 330° C.

They are then passed through a tube type heat exchanger 75 as the hot fluid.

They leave it at a temperature in the order of 200° C. and are then fed via the recycling line 19 into various units of a fractionation system.

First the gases flow in a cooling circuit for separating heavy hydrocarbons. This circuit includes a contact cooling device 76, known to the skilled person as an oil quench, a pump 77 and a heat exchanger 78.

The recycling line 19 discharges into the bottom of the cooler 76.

The pump 77 and the heat exchanger 78 are on a branch connection 19' from the recycling line 19 which leaves the bottom of the cooler 76 and returns to the top of the cooler 76. An offtake line 79 for heavy hydrocarbons is connected to the branch connection 19' between the pump 77 and the heat exchanger 78. The cold fluid of the heat exchanger 78 is water fed via the line 80. This water is converted into steam which leaves via the line 81 connected to a steam exploitation unit (not shown).

The gases entering the cooler 76 are cooled by sprinkling heavy hydrocarbons previously recovered from the bottom of the cooler 76, aspirated by the pump 77, cooled in the heat exchanger 78 to a temperature in the range approximately 120° C. to approximately 130° C. and re-injected into the top of the cooler 76. Thus heavy hydrocarbons are formed continuously and in part taken off via the line 79 and in part recirculated to the cooler 76. The uncondensed gases leave the cooler 76 at a temperature of approximately 150° C. and are fed via the recycling line 19 into a condenser 82 which cools them to a temperature of approximately 45° C.

The condenser 82 is fed with a refrigerant flowing in a cooling circuit including a pump 83 and a fan 84.

In other embodiments it can be replaced by a water quench.

The condensed products accumulate at the bottom of the condenser 82 and are extracted from the latter and fed into a separator 85 (of the lamellar settling tank type) to separate the light hydrocarbons from the water and the organic substances dissolved therein.

The light hydrocarbons are extracted via the line 86 and the aqueous phase is fed via the line 87 into another separator 88, such as a distillation unit, to separate the water from the organic substances dissolved in it.

The water leaving the separator 88 is fed via a line 89 to water treatment plant and the soluble organic substances leaving the separator 88 via a line 90 can be fed from the line 90 to the boiler 16 to be burned in it.

In a similar manner, the light hydrocarbons can equally be fed from the line 86 to the boiler 16.

The uncondensed gases leaving the condenser 82 at a temperature of approximately 45° C. are fed via the recycling line 19 into a water sprayer device 91 also known to the skilled person as a water quench. The device 91 washes the uncondensed gases to remove acids from them, such as hydrochloric acid.

To this end, water is circulated in the device 91 by means of a circuit 92 incorporating a pump 93. The circuit 92 includes a branch connection 94 which feeds the spent water to water treatment plant, for example the plant mentioned above.

A first part of the uncondensed gases leaving the device 91 at a temperature in the order of 45° C. is re-injected into the heat exchanger 75 through a blower 95 which raises its temperature to approximately 100° C.

This part of the gases passes through the heat exchanger 75 as the cold fluid and leaves it at a temperature in the order of 300° C., after which it passes through a coil 21 in which the gases of this part of the uncondensed gases are heated to a temperature in the order of 650° C. by combustion gases from the boiler 16.

On leaving the coil 21 the heated gases enter the feed line 23.

Another part of the uncondensed gases is fed via the input line 17 to the boiler 16 in which it is burned to heat the part of the gases passing through the coil 21. The gases are circulated in the line 17 by a fan 96.

A third part of the uncondensed gases at a low temperature (approximately 45° C.) is injected into the cooling area 3 via an injection line 97, to which a blower 98 is connected.

The hot gases recovered from this cooling area 3 are equally recovered on the extraction line 11.

The hot gases in the offloading area 4 are also recovered and fed into the bottom of the cooler 76 via a recovery line 99.

The combustion gases or flue gases produced by the boiler 16 are fed via a line 100 to a gas/gas heat exchanger 101 for heating the combustion-supporting air used by the boiler 16 and arriving via the line 102 entering the heat exchanger 101.

Finally, natural gas or any other fuel (fuel oil, etc) for starting up the boiler reaches the latter via the line 103.

To be able to burn all of the products mentioned above, the chamber 16 is equipped with multi-fuel burners.

In this plant facility, dehydration and thermolysis are carried out simultaneously and the treatment process is started by heating an inert gas (nitrogen, etc) or previously stored uncondensed gas.

Of course, the plant facility can be provided with uncondensed gas storage means for this purpose.

FIG. 3 does not show the pressure and temperature control means and other regulator valves.

A flue gases evacuation circuit similar to that from FIG. 1 can be provided for the FIG. 3 plant.

The gases escaping from the chamber 2 towards the airlock 1 on opening the door 71 can equally be recovered and fed into the line 99.

These features protect the plant facility from the risk of coking resulting from the condensation of the tars, the risk of clogging by dust and the risk of corrosion by acidic gases.

A plant facility of this kind is particularly energy efficient and generates little pollution.

It goes without saying that the foregoing description has been given by way of non-limiting example only and that many variants can be proposed by the skilled person without departing from the scope of the invention.

In particular, the cyclone 12 and the tube type heat exchanger 15 can be replaced by a cyclowasher, i.e. a washer operating by sprinkling of water adapted to fulfill the functions assigned to the cyclone and to the tube type heat exchanger in the above description of the invention and in particular to lower the temperature of the uncondensed gas fraction to approximately 60° C. to approximately 80° C.

The coil 21 can be replaced by any equivalent gas/gas heat exchange means.

The coal extracted from the solid residues and the tars can be exploited separately.

What is claimed is:

1. A plant facility apparatus for treatment of solid waste products whose disposal is harmful to the environment, said apparatus comprising:

an enclosure for thermolysis of said solid waste products by direct contact with hot gases;

at least one container means for receiving waste products, for moving said waste products into said thermolysis enclosure, and for treating said solid waste products by batch thermolysis within said thermolysis enclosure;

a recycling line for feeding a flow of hot gases into said thermolysis enclosure;

an extraction line for extracting gases from said thermolysis enclosure;

means for cooling at least a portion of the gases extracted from said thermolysis enclosure to a temperature less than approximately 80° C. so as to form condensed products and remaining gases and for separating said condensed products from said remaining gases, said cooling and separating means being disposed along said extraction line;

pump means connected to said extraction line for aspirating said gases extracted from said thermolysis enclosure;

a boiler adapted to burn at least a portion of said remaining gases and communicating via an incoming line with said cooling and separating means; and a line for recycling a portion of the gases extracted from said thermolysis enclosure, said recycling line being fluidically connected to said extraction line and to said feed line, said recycling line further passing through said boiler so as to heat said gases flowing in the recycling line.

2. The plant facility apparatus according to claim 1 wherein said means for cooling and separating separates the extracted gases into a portion containing water and tars and a gaseous portion, said recycling line being connected at one end to said extraction line at a location between said cooling and separating means and said pump means and at an other end to said thermolysis enclosure, an additional pump means being disposed along said recycling line.

3. The plant facility apparatus according to claim 1 wherein said cooling and separating means further comprises a first means for cooling the extracted gases to between approximately 230° C. and approximately 330° C. and a second means for further cooling a portion of the extracted gases to between approximately 60° C. and approximately 80° C., and further wherein said recycling line is connected to the first cooling means at one end and to said thermolysis enclosure at the other end for the purpose of heating at least abortion of the extracted gases from said first means for cooling and further wherein an additional pump means is disposed along said recycling line; and wherein said apparatus further comprises a line for providing the extracted gases from said second means for cooling to said boiler.

4. The plant facility apparatus according to claim 1 further comprising a dehydration enclosure for dehydrating said solid waste products before thermolysis and an enclosure for cooling the solid residues downstream of said thermolysis enclosure.

5. The plant facility apparatus according to claim 4 wherein said dehydration and thermolysis enclosures are one and the same enclosure.

6. The plant facility apparatus according to claim 4 further comprising heat exchange means adapted to reduce the temperature of combustion gases of the boiler to be used for dehydration to between approximately 250° C. and approximately 150° C. and means for exploiting the energy recovered by the heat exchange means.

7. The plant facility apparatus according to claim 1 further comprising means for cleaning the combustion gases of the boiler before they are discharged into the atmosphere.

8. The plant facility apparatus according to claim 1 further comprising a storage tank for storing the gases to be burned, which is connected to the line that feeds the gas into the boiler.

9. The plant facility apparatus according to claim 1 further comprising a feed line for liquefied gas or fuel oil communicating with the line that feeds the gas into the boiler.

10. The plant facility apparatus according to claim 1 wherein said cooling and separating means include a heat exchanger along said recycling line through which the gases extracted from said thermolysis enclosure are passed as the hot fluid and a fractionating system disposed on said recycling line downstream of said heat exchanger through which the gases cooled by the heat exchanger are passed to obtain separated fractions respectively containing heavy hydrocarbons, light hydrocarbons, other organic substances, water and said remaining gases, said recycling line being connected to said heat exchanger downstream of said fractionating system to reinject a part of said remaining gases into said heat exchanger as the cold fluid to absorb heat, and, thereafter be further heated by combustion of another part of said remaining gases.

11. The plant facility apparatus according to claim 10 further comprising a line for injecting a part of the remaining gases into a cooling enclosure downstream of the thermolysis enclosure, the cooling enclosure being equipped with means for discharging gases into said extraction line.

12. The plant facility apparatus according to claim 10 wherein the fractionating system further includes a device for washing the remaining gases with water before they are fed into the heat exchanger.

13. The plant facility apparatus according to claim 1 further comprising fluidic connection means adapted to provide hot gases into said at least one container means receiving solid waste products.

14. The plant facility apparatus according to claim 1 wherein the boiler is equipped with fiber type burners or multi-fuel burners.

15. A method of treating solid waste products whose disposal is harmful to the environment, said method comprising the steps of:

placing said waste products in at least one container means and moving said waste products into a thermolysis enclosure;

treating said waste products in said thermolysis enclosure to a batch thermolysis process thus forming thermolysis gases;

aspirating said thermolysis gases produced by said batch thermolysis process from said thermolysis enclosure thus forming aspirated gases;

cooling at least a first portion of said aspirated gases to a temperature less than 80° C. thereby creating condensed products and remaining gases;

separating said condensed products from said remaining gases;

burning at least a first portion of said remaining gases thus forming combustion gases;

heating a second portion of said aspirated gases or a second portion of said remaining gases by indirect heat exchange with said combustion gases thus forming a heated portion;

recycling said heated portion by feeding said heated portion back into said thermolysis enclosure; and directing said heated portion so as to come into direct contact with said waste products.

16. A method according to claim 15 wherein the step of directing said heated portion comprises injecting said heated portion into a charge of solid products to be treated and put into said at least one container means.

17. A method according to claim 15 wherein said aspirated gases are directed into a cyclowasher adapted to divide said aspirated gases into a condensed product portion comprising water and tars and said remaining gases at a temperature in the range between approximately 60° C. and approximately 80° C.

18. A method according to claim 15 wherein said aspirated gases are directed into a cyclone to divide them into a condensed product portion comprising water and tars and said remaining gases and said remaining gases are directed into a cooler for reducing its temperature to between approximately 60° C. and approximately 80° C.

19. A method according to claim 15 further comprising the step of adding liquefied gas or fuel oil to said first portion of said remaining gases to be burned.

20. A method according to claim 19 wherein said solid waste products are dehydrated before thermolysis in said thermolysis enclosure by means of combustion gases resulting from the combustion of one of said liquefied gas, previously stored remaining gases, or a mixture thereof.

21. A method according to claim 20 wherein the temperature of the combustion gases to be used for dehydration is reduced to between approximately 250° C. and approximately 150° C. by heat exchange and the energy recovered is exploited.

22. A method according to claim 15 wherein the step of aspirating the gases produced further comprises the step of directing said aspirated gases into a heat exchanger as the hot fluid and thereafter feeding said gases into a fractionating system to obtain separated fractions respectively containing heavy hydrocarbons, light hydrocarbons, other organic substances, water, and said remaining gases, and said second portion of said remaining gases is re-injected into the heat exchanger as the cold fluid to absorb heat, and, thereafter be further heated by combustion of said first portion of said remaining gases.

23. A method according to claim 22 wherein at least a part of said light hydrocarbons and/or at least a part of said organic substances is burned to heat the gases to be fed back into said thermolysis enclosure.

24. A method according to claim 22 wherein the remaining gases are washed with water before injection into the heat exchanger.

25. A method according to claim 22 further comprising the step of injecting a third portion of said remaining gases into a cooling enclosure downstream of said thermolysis enclosure and said third portion of said remaining gases present in this cooling enclosure are aspirated and injected into said heat exchanger as the hot fluid.

26. A method according to claim 15, wherein said aspirated gases have a temperature of approximately 500° C.

27. A method according to claim 15, wherein the pressure of the thermolysis enclosure is in the range of 200 mbars to 1.2 bars.

* * * * *